United States Patent [19]

Mautner

[11] Patent Number: 4,676,535

[45] Date of Patent: Jun. 30, 1987

[54] SECURITY SEAL

[75] Inventor: Jacob E. Mautner, Keyport, N.J.

[73] Assignee: E. J. Brooks Company, Newark, N.J.

[21] Appl. No.: 721,412

[22] Filed: Apr. 9, 1985

[51] Int. Cl.[4] ..... B65D 33/34

[52] U.S. Cl. ..... 292/320; 24/16 PB; 292/321

[58] Field of Search ..... 292/320, 323, 318, 319, 292/322, 326, 308, 310, 321; 24/16 PB, 16 R, 30.5 P, 17 AP

[56] References Cited

U.S. PATENT DOCUMENTS

| | | | |
|---|---|---|---|
| 555,412 | 2/1896 | Tyson | 292/320 |
| 1,964,897 | 7/1934 | Wenk | 292/320 |
| 2,632,217 | 3/1953 | Flora | 24/16 PB |
| 2,969,570 | 1/1961 | Petri et al. | 292/322 |
| 3,114,184 | 12/1963 | Bigaouette | 24/16 PB |
| 3,163,899 | 1/1965 | Karass | 24/16 PB |
| 3,224,055 | 12/1965 | Orser | 24/16 PB |
| 3,265,426 | 8/1966 | Brooks et al. | 24/16 PB |
| 3,341,903 | 9/1967 | Buntic | 24/16 PB |
| 3,367,701 | 2/1968 | Wenk | 292/321 |
| 3,553,793 | 1/1971 | Long et al. | 24/16 PB |
| 3,633,957 | 1/1972 | Moberg | 292/308 |
| 3,909,884 | 10/1975 | Weckesser | 24/16 PB |
| 4,106,802 | 8/1978 | Lozio | 292/320 |
| 4,389,754 | 6/1983 | Sohma | 24/16 PB |

FOREIGN PATENT DOCUMENTS

| | | | |
|---|---|---|---|
| 10688 | of 1889 | United Kingdom | 292/308 |

*Primary Examiner*—Robert L. Wolfe
*Assistant Examiner*—Lloyd A. Gall
*Attorney, Agent, or Firm*—Carella, Byrne, Bain & Gilfillan

[57] ABSTRACT

An all plastic fastener adapted, in one embodiment, for use as a seal for a coin bag or the like, and in another embodiment as a cable tie or the like.

The seal comprises a housing having an aperture therethrough and an integral shackle extending from the housing for insertion into the housing opening. The shackle has ratchet teeth along the outer edges, and the housing has internal means for engaging the ratchet teeth when the shackle is pulled through the opening, to prevent reverse movement of the shackle in the housing. In a preferred embodiment of the invention the shackle has an axial slot disposed in the portion having the teeth to allow the sides of the shackle to flex together when it is drawn through the housing. When used as a security seal, a locking member may be inserted into the slot between the shackle portions in the housing to maintain them pressed outwardly into engagement with the locking members in the housing. The locking member may be a segment of the housing wall impressed inwardly by a suitable tool, or may be a member formed on the end of an integral strap molded in the slot, which may be pulled into position after the seal is assembled.

3 Claims, 11 Drawing Figures

FIG. 2
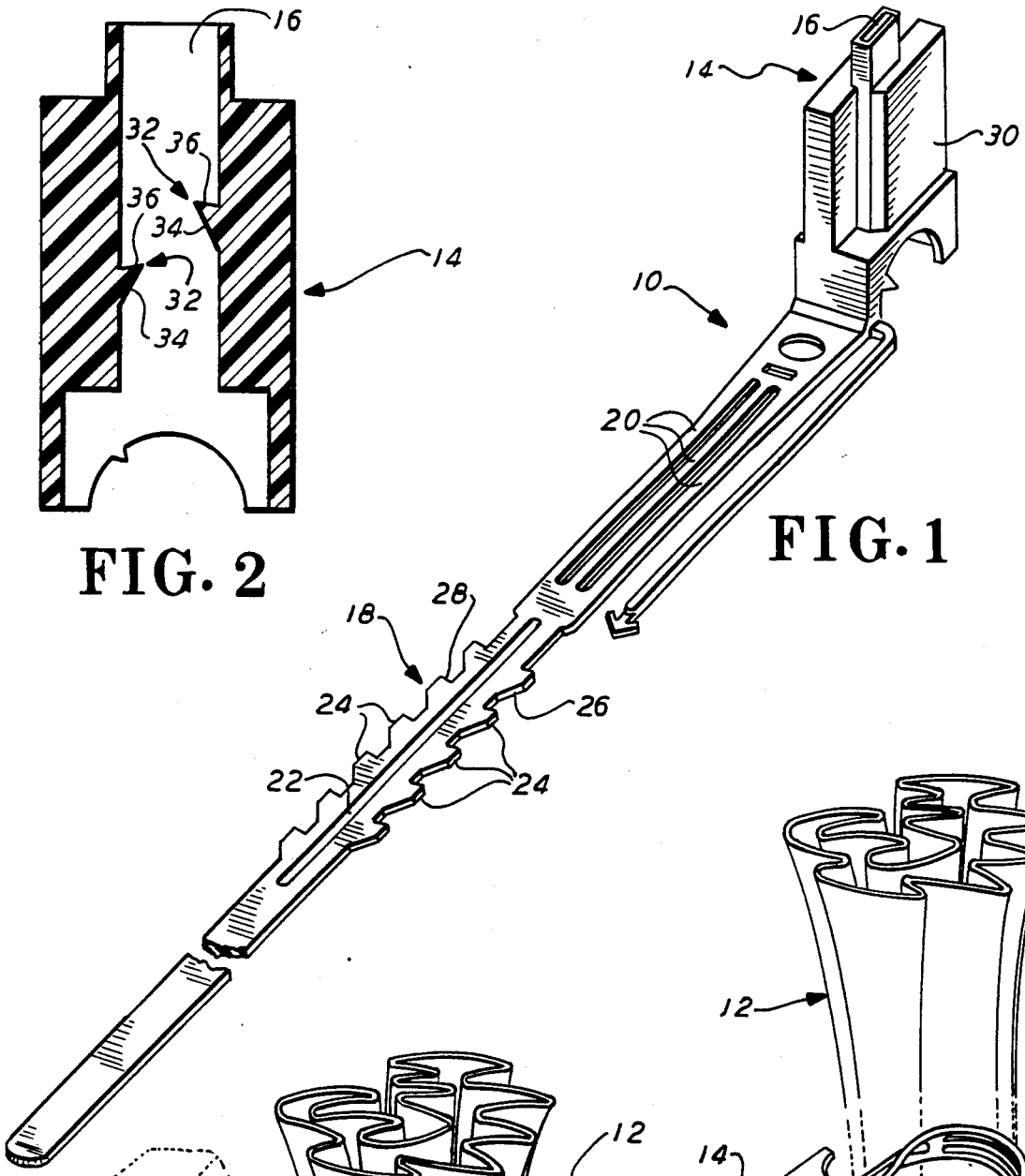
FIG. 1
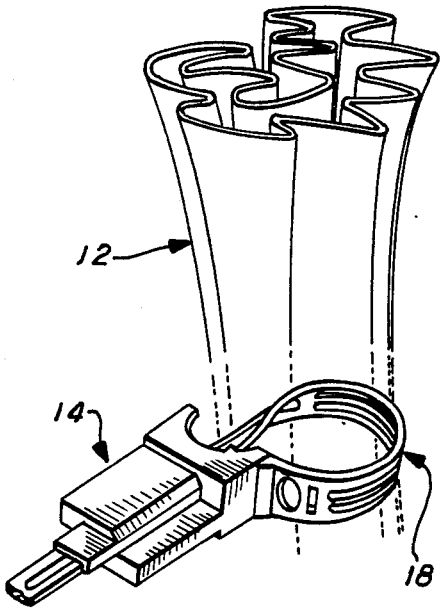
FIG. 3
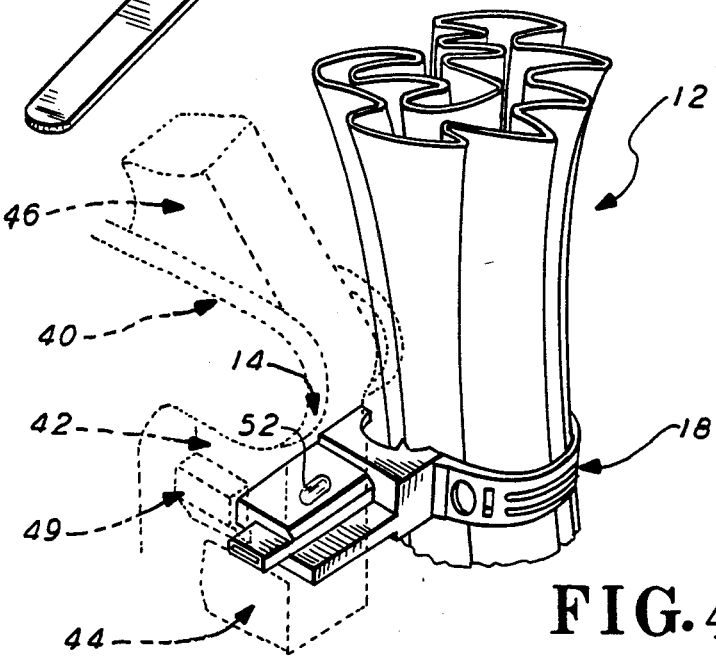
FIG. 4

SECURITY SEAL

BACKGROUND OF THE INVENTION

A common use for security seals is for sealing closed the mouth of a bag, such as a money bag or mail bag. Several types of seals for this purpose are in common use, and comprise a plastic housing and a shackle, with a metal ferrule in the housing which, after the shackle has been passed through the housing and tightened around the bag, is crimped by a suitable tool to lock the shackle in the housing. However, for reasons of economy, it would be desirable that such seals be formed of a single piece of molded plastic.

Although several types of all plastic seals have been proposed for such use, none has achieved any substantial success because they have been found susceptible to removal and replacement by an unauthorized person without leaving evidence of tampering. Since the plastic of which the seal is formed is necessarily flexible, it is also stretchable, and in some cases the seal may be stretched enough to be slipped over the end of the bag and replaced onto the bag after some or all of the contents have been removed. In other cases the locking mechanism, which is formed of the same resilient plastic, may be released with a suitable tool without damage, and the seal may than be re-applied to the bag after the contents have been removed.

Another problem with such all plastic seals has been the fact that if the locking mechanism is made strong enough to resist tampering, it may be difficult to pull the shackle through the housing far enough to enable the end of the shackle to be grasped by the closing tool, which can be tiring to personnel who assemble hundreds of seals per day.

SUMMARY OF THE INVENTION

This invention provides an all plastic fastener adapted, in one embodiment for use as a seal for a coin bag or the like, and in another embodiment, for use as a wiring harness fastener or a cable tie or the like. The fastener comprises a housing and an integral shackle extending from the housing. The shackle is provided with ratchet teeth on the outer edges thereof and is also provided with structure that allows the outer edges of the shackle to flex together when the shackle is drawn through the housing passage. The housing has means therein for engaging the ratchet teeth of the shackle, to latch the shackle in place after it has been tightened around the neck of a bag or around a bundle of wires. In one version of the invention, the means allowing the outer edges of the shackle to flex together comprises a centrally located elongated slot extending the length of the shackle portion having the ratchet teeth, forming two collateral shank portions. The slot, for some applications, may have small transverse connecting members extending between the shackle portions to control the flexibility thereof, or the shackle may have a series of apertures suitably spaced to give the desired flexibility.

In applications in which the fastener is to be used as a bag seal, the housing may be shaped and dimensioned to allow a portion of the housing wall to be punched in by a suitable tool, with said punched in portion entering the shackle slot to spread the shackle portions and force the ratchet teeth into engagement with the teeth engaging means in the housing to lock the shackle in place.

In an embodiment of the invention which is to be used as a bag seal, a portion of the shackle which is positioned to be around the bag neck when assembled is formed of a plurality of string-like portions which are relatively weak individually, and are subject to fracture if an attempt is made to slide the seal off of the bag and reassemble it after the bag contents have been removed.

In another embodiment of the invention, a locking member may be molded integrally with the fastener with an associated pulling member attached thereto, said locking member and the pulling member being so positioned that after the fastener is assembled around a bag or the like, the locking member may be pulled into a locking position by the pulling strap. The pulling strap may be provided with a breakaway portion so that access to the locking member is not possible after it has been pulled into the locking position.

BRIEF DESCRIPTION OF THE FIGURES OF THE DRAWING

FIG. 1 is a perspective view of a seal embodying the features of the invention.

FIG. 2 is a view in section of the housing portion of the seal of FIG. 1.

FIG. 3 is a view of the seal of FIG. 1 assembled onto the neck of a bag.

FIG. 4 is a view similar to FIG. 3 in which the seal has been locked onto the bag by an embossing tool.

DESCRIPTION OF THE ILLUSTRATED EMBODIMENTS

Figure 7:
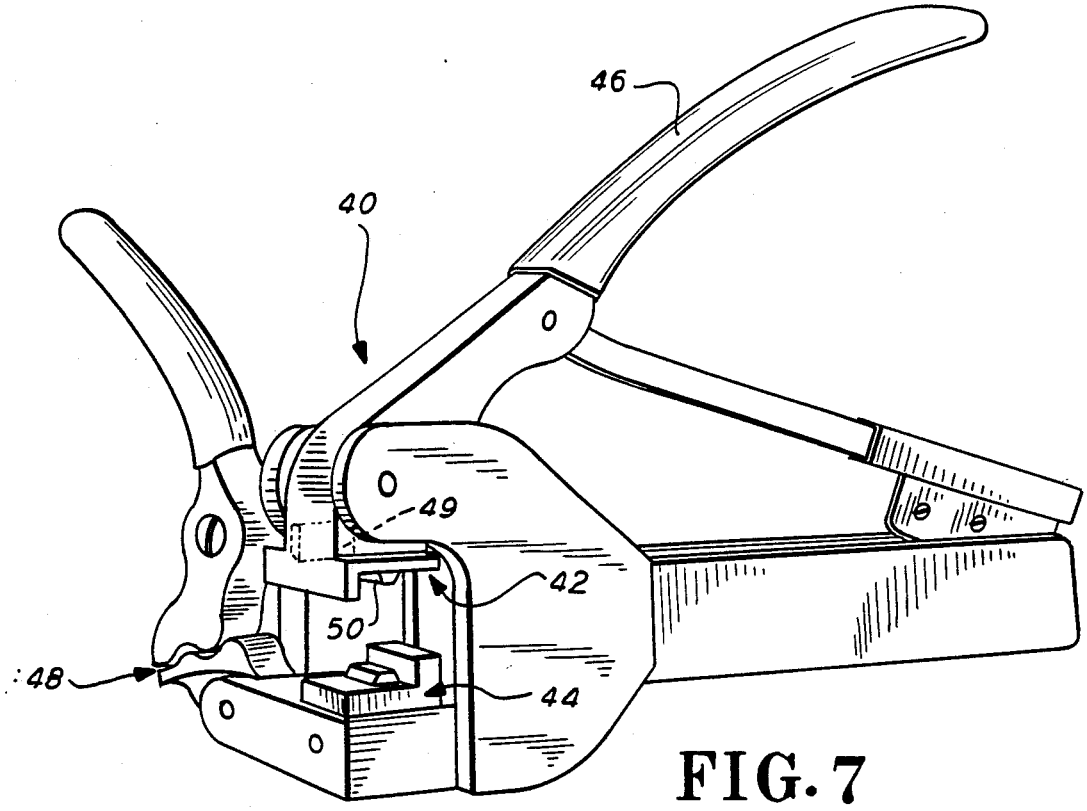
FIG. 7 is a perspective view of a tool for use in assembling the seal of FIG. 1.
Figure 5:
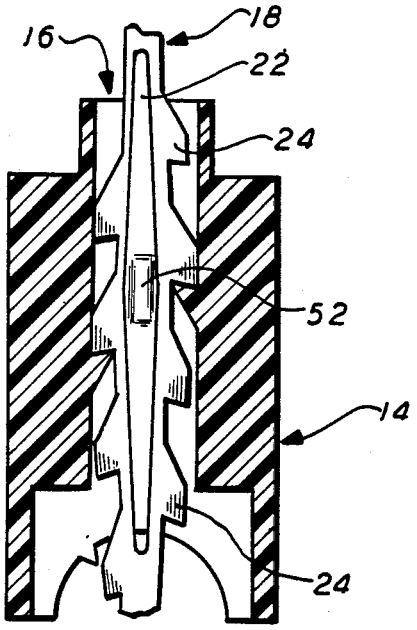
FIG. 5 is a view in section of the seal housing of FIG. 4 with the internal shackle portion in plan view, illustrating the action of the embossing imparted by the tool.
Figure 6:
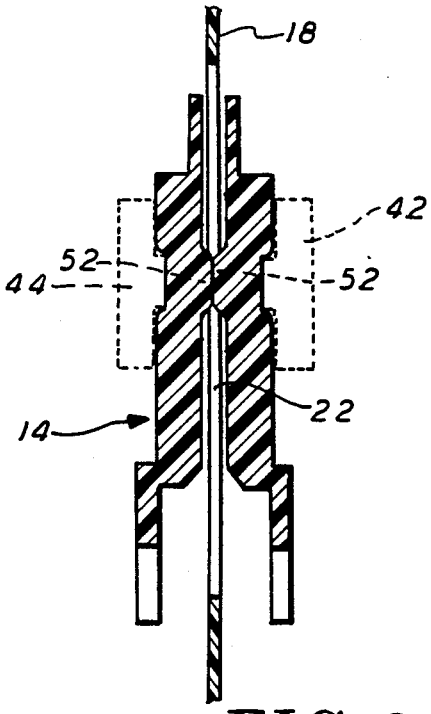
FIG. 6 is a view in section of the housing of FIG. 4 taken in a direction perpendicular to that of the section of FIG. 5, illustrating the embossing on both sides of the seal housing.
Figure 8:
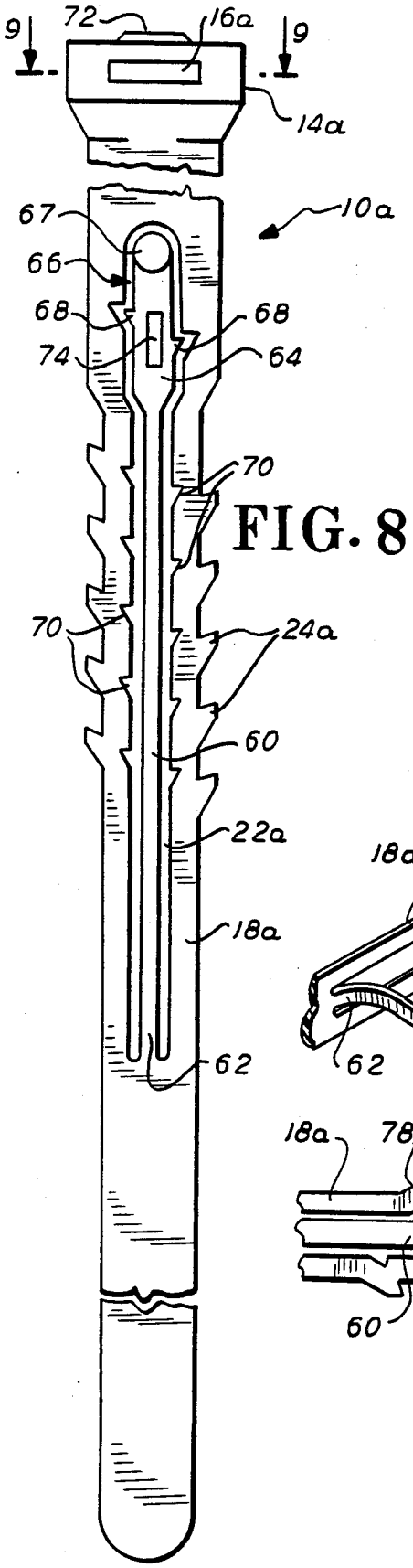
FIG. 8 is a top plan view of a modified form of seal embodying the features of the invention.

Referring to FIGS. 1–6 of the drawing, there is illustrated a security seal 10, which is adapted for use as a seal for the neck of a bag such as a coin or currency bag 12.

The seal 10 is preferably formed of a single piece of injection molded plastic such as nylon, and comprises a housing 14 having a passage 16 extending therethrough, and a shackle 18 extending from one end of the housing.

The shackle 18 has a portion adjacent the end connected to the housing which is formed of a plurality of filaments or string-like portions 20, and a portion remote therefrom that has a central elongated slit 22. The portions 20 are so positioned on the shackle that they will be positioned around the bag neck when the seal is assembled, and the slit 22 is so positioned on the shackle that a portion thereof will be inside the housing when the seal is assembled, for purposes to appear hereinafter.

The outside edges of the shackle alongside the slit 22 are provided with ratchet teeth 24 which have rearwardly sloping forward surfaces 26 and abrupt rear surfaces 28 which may slope slightly rearwardly.

The housing 14 is generally rectangular in cross-section with laterally extending portions 30 to receive identifying indicia in a manner to be described. The passage 16 through the housing is generally rectangular in cross-section with a thickness which is substantially equal to the thickness of the shackle 18.

To provide means in the housing for engaging the ratchet teeth so as to prevent rearward movement of the tightened shackle, a projection 32 is provided on each sidewall of the passage 16, each projection having a sloping surface 34 on the side toward the shackle entrance end of the housing and an abrupt surface 36 on the side toward the shackle exit end of the housing.

Referring to FIG. 7 of the drawing, there is ilustrated a hand tool 40 for use in the assembly and locking of the seal 10. The tool 40 may be similar in many respects to the seal press illustrated and claimed in U.S. Pat. No. 3,911,970, and comprises a pair of jaws 42 and 44 which are movable toward each other by means of a handle 46 to grip the seal body therebetween. A shackle tightening mechanism is provided alongside the jaws, which comprises shackle gripping jaws 48 pivoted to the frame of the press and operable by a handle to grip the shackle and pull it through the housing 14 to tighten it around the neck of the bag. Means may also be provided to cut off the excess shackle protruding out of the housing, said means comprising a knife which may be operated manually at the end of the sealing operation, or automatically in the manner described in said above identified patent.

In the seal press illustrated and described herein, the seal housing gripping jaw 42 is provided with a downwardly projecting tooth 50 which is suitably positioned to emboss a segment 52 of the housing wall inwardly into the slot 22 to lock the shackle in the housing in a manner to appear hereinafter.

As illustrated in FIGS. 4–7, the seal 10 may be assembled by inserting the end of the shackle 18 through the housing aperture 16 and pulling the shackle tightly around the gathered neck of the bag 12 by the use of the jaws 48 of the tool 40. During such pulling the ratchet teeth 24 on the side edges of the shackle snap past the internal projections 32 of the housing passage 16, which action is facilitated by the presence of the slit 22, which allows the side edges to flex together during the axial movement of the shackle therethrough.

When the shackle has been pulled to the desired tightness, the jaws 48 may be released, and the tension of the shackle is maintained by the engagement of a ratchet tooth 24 with a housing aperture projection 32.

To thereafter lock the shackle securely in the housing, the jaws 42,44 of the tool 40 may be applied to the seal housing and the handle 46 operated to cause the tooth 50 to impress a segment 52 of the housing wall inwardly into the housing and into the slit 22 between the shackle portions, to thereby maintain the shackle portions spread apart into locked engagement with the housing projections 32.

Thereafter the portion of the shackle extending from the exit end of the housing may be cut off at the end of the housing so that even if in some manner the strap is released from the housing to allow access to the bag contents, it would be impossible to pull the strap back through the housing to the same tightness and to a position such that the end of the shackle is positioned exactly at the exit end of the housing.

Referring now to FIGS. 8–11, there is illustrated a modified form of seal **10*a* embodying the features of the invention. The seal 10*a* is similar in many respects to the seal 10 previously described, in that it comprises a housing 14*a* having a passage 16*a*, and a shackle 18*a* extending from the housing. The remote portion of the shackle has a central slot 22*a*, and ratchet teeth 24*a*. The housing 14*a* has projections 32*a* in the passage 16*a* for engaging the ratchet teeth 24*a*** when the shackle is pulled through the housing.

To provide means for locking the shackle in the housing without the need of a tool to impress a segment of the housing wall inwardly in the manner previously described, an integral locking strap 60 is provided which is disposed in the slot **22*a* and extends from a first end 62 which is attached to the strap at an end of the slot to a laterally enlarged free end 64 disposed in a wider portion 66 of the slot 22*a*, with a stop member 67 on the free end which extends upwardly and downwardly out of the plane of the strap. The sides of the laterally enlarged free end 64 of the locking strap are provided with locking teeth 68, and the inner edges of the shackle are provided with notches 70 shaped and positioned to receive the teeth 68** in latching engagement when the locking strap is pulled, as will appear hereinafter.

Figure 9:
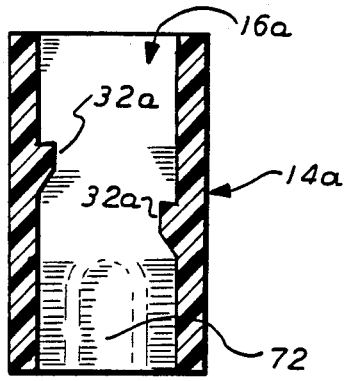
FIG. 9 is a view in section taken on line 9—9 of FIG. 8.
Figure 10:
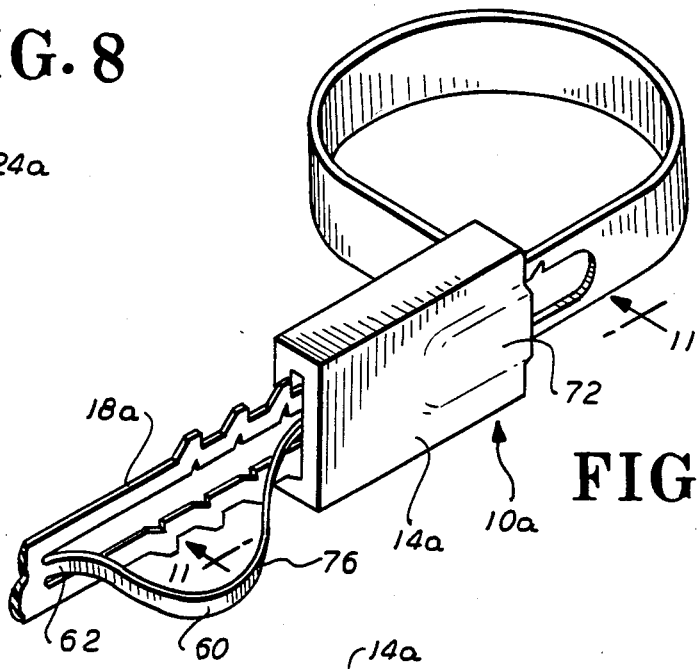
FIG. 10 is a perspective view of the seal of FIG. 8 in which the shackle has been assembled into the housing and the locking strap pulled to the locking position.
Figure 11:
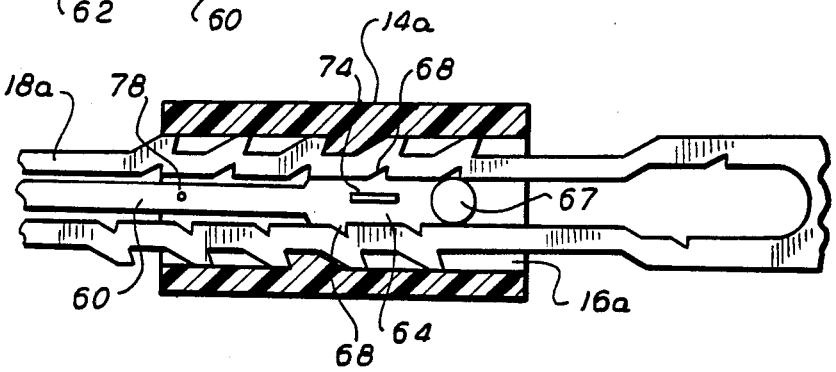
FIG. 11 is a view of the housing portion of the seal of FIG. 10 in which the seal body is in section and the shackle and locking strap are in plan.

As illustrated in FIGS. 9–11, after the seal is assembled onto the neck of a bag and the shackle **18*a* tightened in the manner previously described, the locking strap 60 may be pulled so that the free end 64 thereof moves longitudinally through the slot 22*a*, with the wider portion 66 of the strap entering between the strap portions which have the notches 70**.

When the strap 60 has been pulled far enough that the teeth 68 on the wider portion 66 of the strap are locked in a set of notches 70, the stop member 67 has entered a recess 72 in the adjacent end of the housing to prevent further movement of the strap. To allow the necessary edgewise flexing of the locking strap 60 to permit the enlarged free end and associated teeth 68 to pass into the portion of the slot **22*a* having the notches 70, a slot 74 may be provided in the locking strap 60 between the teeth 68**.

After the locking strap 60 has been pulled and locked as described above, the external loop 76 formed in the strap may be cut off, or in a modification of the device, a weakened portion 78 may be provided which is so dimensioned that it will not break when the locking strap is pulled to the locked position, but will break when a stronger pull is thereafter applied to the locking strap.

Although the illustrated embodiments of the device are each made of a single piece of injection molded plastic, in some cases it may be preferable to make the device of individual components assembled in any effective manner.

Since certain other changes apparent to one skilled in the art may be made in the illustrated embodiments of the device, it is intended that all matter contained herein be interpreted in an illustrative and not a limiting sense.

I claim:

1. In a security seal of the type comprising a housing having walls forming a passage therethrough and a shackle extending from the housing and having a free end for insertion into the housing, said shackle having ratchet teeth along at least one outer edge thereof, said housing having shackle locking means in the passage for engaging said ratchet teeth when the shackle is pulled through the passage to prevent reverse movement thereof, the improvement comprising a locking strap associated with the shackle and having a fixed end and a free end, said locking strap being so positioned in relation to the shackle that after the seal is assembled with an article to be sealed, a portion of the locking strap near the fixed end extends from housing so that it can be grasped and pulled to pull the free end into the housing, said free end having shackle engaging means disposed thereon which is shaped and dimensioned to force the ratchet teeth into locking engagement with the shackle locking means in the housing passage when so pulled into the passage.

2. A security seal as set out in claim 1 in which said shackle has a central elongated slot and the locking strap is disposed in the slot, and said shackle engaging means on the free end of the locking strap is shaped and dimensioned to be positioned in the slot between the two shackle portions after being pulled into the housing to force both shackle portions outwardly against the housing.

3. A security seal as set out in claim 2 in which the shackle engaging means and the shackle have cooperating means for locking the shackle engaging means against reverse movement.

* * * * *